US007043834B2

(12) United States Patent
Endo et al.

(10) Patent No.: US 7,043,834 B2
(45) Date of Patent: May 16, 2006

(54) METHOD OF INSERTING CONNECTION TERMINALS INTO HALF-FITTING PREVENTION CONNECTOR

(75) Inventors: Tomomi Endo, Shizuoka (JP); Naoto Taguchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 502 days.

(21) Appl. No.: 10/143,991

(22) Filed: May 14, 2002

(65) Prior Publication Data

US 2002/0170174 A1 Nov. 21, 2002

(30) Foreign Application Priority Data

May 15, 2001 (JP) ..... P2001-145376
Sep. 5, 2001 (JP) ..... P2001-269061

(51) Int. Cl.
*H01R 43/20* (2006.01)

(52) U.S. Cl. ..... 29/876; 29/884; 29/842; 29/854

(58) Field of Classification Search ..... 29/876, 29/884, 842, 854
See application file for complete search history.

(56) References Cited

U.S. PATENT DOCUMENTS 4,658,503 A * 4/1987 Eaton ..... 29/854
4,843,714 A * 7/1989 Whiteman, Jr. ..... 29/874
4,936,011 A * 6/1990 Berry et al. ..... 29/845
5,108,305 A * 4/1992 Suzuki ..... 439/488
5,598,624 A * 2/1997 Ito et al. ..... 29/593
5,743,008 A * 4/1998 Endo et al. ..... 29/842
5,851,128 A * 12/1998 Nakata et al. ..... 439/752
6,269,539 B1 * 8/2001 Takahashi et al. ..... 29/883

FOREIGN PATENT DOCUMENTS

| | | |
|---|---|---|
| DE | 41 33 336 C2 | 9/1992 |
| DE | 44 46 854 C2 | 12/1996 |
| DE | 691 21 840 T2 | 1/1997 |
| DE | 198 37 896 A1 | 2/2000 |
| DE | 199 20 481 C1 | 1/2001 |
| GB | 2 371 153 A1 | 7/2002 |
| JP | 7-192808 | 7/1995 |

* cited by examiner

*Primary Examiner*—A. Dexter Tugbang
*Assistant Examiner*—Terri Lynn Smith
(74) *Attorney, Agent, or Firm*—Sughrue Mion, PLLC

(57) ABSTRACT

In a half-fitting prevention connector (31) of the invention, a fitting detection member (60) is moved to a proper-fitting detecting position in a female connector (40) before connection terminals are automatically inserted by an automatic terminal inserting machine. As a result of this movement, a rear end of the fitting detection member (60) substantially coincides with a rear end surface of the housing of the female connector (40), so that the connection terminals can be automatically inserted into terminal accommodating chambers (40*a*) by the automatic terminal inserting machine.

7 Claims, 15 Drawing Sheets

31
65
61b
63
64
63a
61a
45a
45
47
42
49
43
43a
61b
61
60
43
44
40b
41
43a
40
47
40a
40c

METHOD OF INSERTING CONNECTION TERMINALS INTO HALF-FITTING PREVENTION CONNECTOR

BACKGROUND OF THE INVENTION

1. Field of the Invention

The present invention relates to a method of automatically inserting connection terminals into a half-fitting prevention connector in which when a pair of male and female connector housings are fitted with each other, a half-fitted state of the male and female connector housings is detected according to whether or not a fitting detection member attached over one connector housing is able to slidingly move to a proper-fitting detecting position.

The present application is based on Japanese Patent Applications No. 2001-145376 and 2001-269061, the entire contents of which are incorporated herein by reference.

2. Related Art

As shown in FIGS. 13 and 14, a conventional half-fitting prevention connector is arranged such that when a pair of male and female connector housings M and F are fitted with each other, a half-fitted state of the male and female connector housings M and F is detected according to whether or not a fitting detection member M1 fitted to one connector housing, i.e., the male connector housing M, is able to slidingly move to a proper-fitting detecting position (reference should be had to JP-A-7-192808).

Namely, as shown in FIG. 13, the male connector housing M has a flexible lock arm 5 rising upward from a front end side of an upper wall 4*a* of a housing body 4 and extending in the rearward direction of the housing. A locking projection 5*b* is projectingly provided on an upper surface of an intermediate portion of this flexible lock arm 5, and a detecting portion 5*c* is projectingly provided at a rear end thereof. In addition, a pair of protective walls 7 are respectively provided uprightly on both sides of the flexible lock arm 5 in such a manner as to be spaced apart therefrom and parallel thereto.

In addition, the fitting detection member M1 has a pair of flexible retaining pieces 9 provided on a base portion 8 so as to be located on both sides of the flexible lock arm 5. Further, a pair of detecting projections 10 which are brought into contact with the detecting portion 5*c* of the flexible lock arm 5 are each provided uprightly on an intermediate portion between the base portion 8 and the flexible retaining piece 9.

In addition, the female connector housing F has a lock hole 2*b* in an upper wall 2*a* in an upper portion of a housing body 2 which is attached over the aforementioned flexible lock arm 5 when the male and female connector housings M and F are fitted with each other. Further, two disengaging arms 3 extending forward from a rear wall 2*c* and each having a projection 3*a* at a distal end thereof are provided inside the upper wall 2*a*.

As shown in FIG. 14, the fitting detection member M1 is pushed in from the rear side of the male connector housing M and is held in an initial position.

Next, as shown in FIG. 15, if the female connector housing F and the male connector housing M are fitted with each other, the locking projection 5*b* of the flexible lock arm 5 is engaged in the lock hole 2*b* (see FIG. 13), the disengaging arms 3 in the female connector housing F advance to the lower sides of the flexible retaining pieces 9, and the projections 3*a* raise the free ends of the flexible retaining pieces 9.

At this time, since the fitting detection member M1 as a whole tilts slightly toward the rear side in conjunction with the rising of the free ends of the flexible retaining pieces 9, if the fitting detection member M1 is further advanced, upper ends of the detecting projections 10 come into contact with the detecting portion 5*c*. Then, as shown in FIG. 16, the detecting projections 10 pass the lower side of the detecting portion 5*c* and are retained in a proper-fitting detecting position. As a result of the movement of this fitting detection member M1 from the initial position to the proper-fitting detecting position, it is possible to detect the completely fitted state of the male and female connector housings M and F.

In a half-fitted state of the male and female connector housings M and F, in a case where an excessive pressing force is applied to the fitting detection member M1, the detecting projections 10 of the flexible retaining pieces 9 come into contact with the detecting portion 5*c*, and a force which lowers the flexible lock arm 5 acts. Therefore, the flexible lock arm 5 is not deflected upward, and the advance of the fitting detection member M1 is prevented, thereby making it possible to detect the half-fitted state.

With the above-described fitting detection member M1, the base portion 8 at the rear end projects from the rear end of the housing body 4 in the initial position of the fitting detection member M1. Therefore, it is impossible to use an automatic terminal inserting machine in the insertion of connection terminals into the male connector housing M, so that there has been a problem in that the connection terminals must be inserted one at a time by manual operation, thereby causing a decline in the operating efficiency.

SUMMARY OF THE INVENTION

The invention has been devised in view of the above-described problem, and its object is to provide a method of automatically inserting connection terminals into a half-fitting prevention connector, which permits automatic insertion using an automatic terminal inserting machine by providing an arrangement such that when the connection terminals are inserted, the rear end of the fitting detection member fitted to one of male and female connector housings does not project from the rear end of that connector housing.

The method of automatically inserting connection terminals into a half-fitting prevention connector of the invention for attaining the above objects is an inserting method of connection terminals into a half-fitting prevention connector including a first connector housing having a flexible lock arm, a second connector housing having an engaging portion for engaging a lock portion of the lock arm and adapted to be connected to the first connector housing by engagement between the lock portion and the engaging portion at the time of fitting with the first connector housing, and a fitting detection member attached over the first connector housing slidably along fitting direction of the connector housings so as to detect a half-fitted state of the connector housings according to whether or not the fitting detection member is able to slidingly move from a first position (initial position) before fitting of the first and second connector housings to a second position (proper-fitting detecting position) after the fitting of the first and second connector housings, the inserting method comprising the steps of:

moving the fitting detection member to a position where a rear end of the fitting detection member substantially coincides with a rear end surface of the first connector housing or a position where the rear end of the fitting detection member is located forwardly of the rear end surface of the first connector housing;

inserting the connection terminals into the first connector housing;

moving the fitting detection member to the first position where the rear end of the fitting detection member projects rearwardly of the rear end surface of the first connector housing; and effecting an operation of engaging the connector housings.

According to the method of automatically inserting connection terminals into a half-fitting prevention connector constructed as described above, the connection terminals are automatically inserted into the connector housing by the following procedures (1) to (3) to prepare for the operation of fitting of the connector housings:

(1) The fitting detection member is moved to a position where the rear end of the fitting detection member substantially coincides with the rear end surface of the first connector housing, or a position where the rear end of the fitting detection member is located forwardly of the rear end surface of the first connector housing.

(2) An appropriate number of connection terminals are automatically inserted from the rear end surface of the first connector housing.

(3) Before the fitting with the second connector housing, the fitting detection member is moved to the initial position where the fitting detection member projects rearwardly of the rear end surface of the first connector housing.

The above-described procedure (1) suffices if the fitting detection member is moved to a position where the rear end of the detection member substantially coincides with the rear end surface of the first connector housing or a position where the rear end of the detection member is located forwardly of the rear end surface of the first connector housing. In addition, the rearward projection of the detection member is allowed if it is of such a measure that at least an ordinary automatic terminal inserting machine can be used. However, in a case where the complete fitted state is detected by the complete coincidence between the rear end of the detection member and the rear end surface of the first connector housing, the proper position of terminal insertion is preferably set to the position where the rear end of the detection member and the rear end surface of the first connector housing coincide.

In addition, in the case where the connection terminals are automatically inserted from the rear end surface of the first connector housing in the procedure (2), the automatic terminal inserting machine may be provided with the function of moving the fitting detection member to the position where the connection terminals can be automatically inserted before the insertion of the connection terminals after supplying the first connector housing to the automatic terminal inserting machine.

Further, in the case where the fitting detection member is moved to the initial position where the fitting detection member projects rearwardly of the rear end surface of the first connector housing in the procedure (3), it is also possible to simultaneously effect this procedure in an inspection process for electrically inspecting the inserted state of the connection terminals inserted in the connector housing.

Namely, the fitting detection member is positioned in an appropriate terminal inserting position starting with the initial stage in which the fitting detection member is attached over the first connector housing, and an inspection jig (checker fixture) which is used in the process of terminal insertion inspection after the insertion of the connection terminals may be provided with a member for moving the fitting detection member from the appropriate terminal inserting position to the initial position.

Further, in the invention, the fitting detection member may be configured to be located at the second position when the connection terminals are inserted into the first connector housing.

The rear end of the fitting detection member may be preferably flush with the rear end surface of the first connector housing when the fitting detection member is located at the second position.

The inserting method of the invention may further include the steps of moving the fitting detection member to the second position and detecting a complete fitting of the first and second connector housings.

DETAILED DESCRIPTION OF THE PREFERRED EMBODIMENTS

Figure 1:
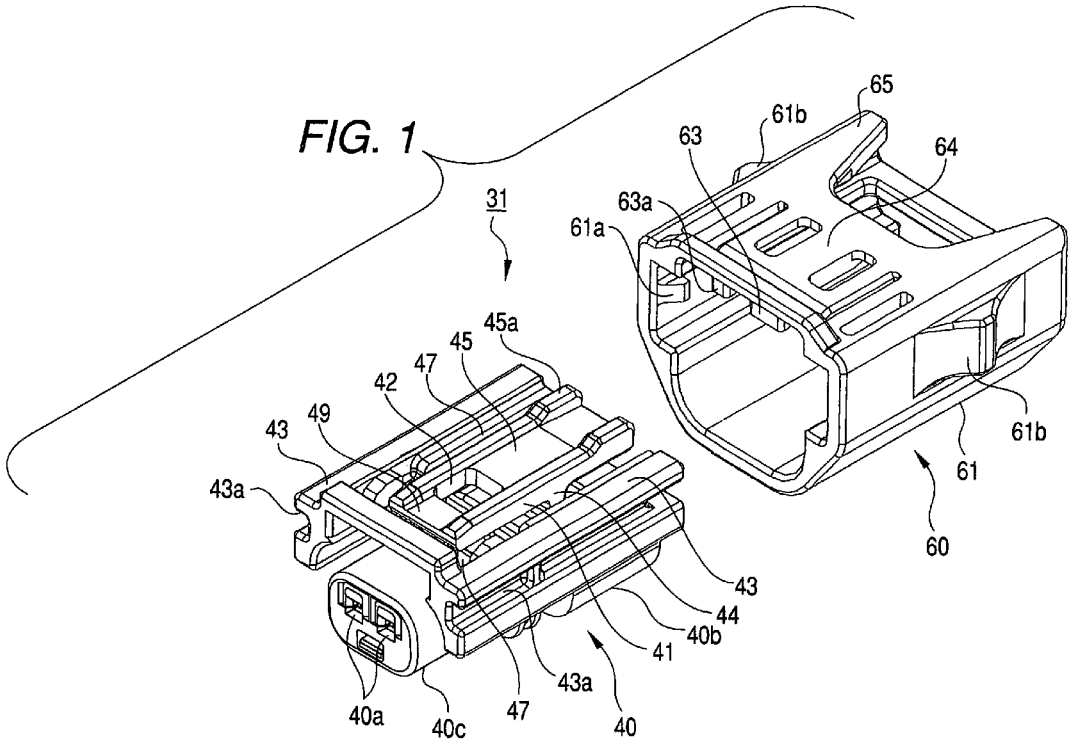
FIG. 1 is an exploded perspective view illustrating the first embodiment of the method of automatically inserting connection terminals into a half-fitting prevention connector in accordance with the invention.
Figure 2:
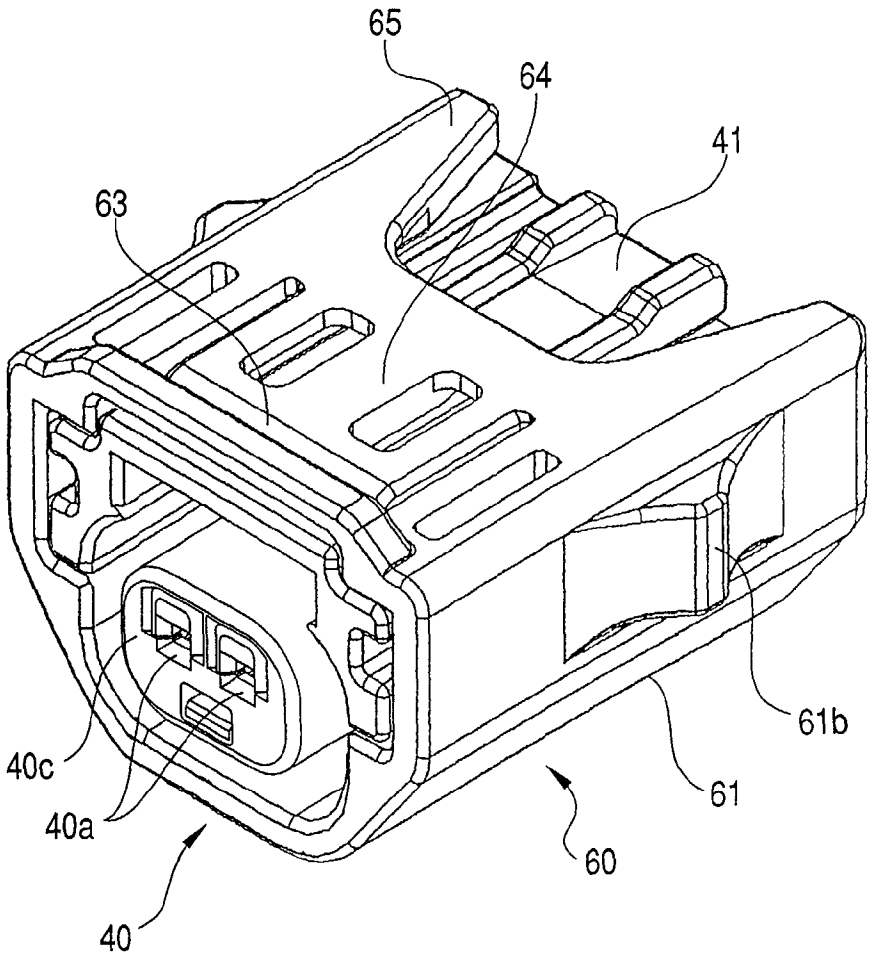
FIG. 2 is a perspective view illustrating a state in which a fitting detection member is incorporated in a female connector housing in FIG. 1.
Figure 3:
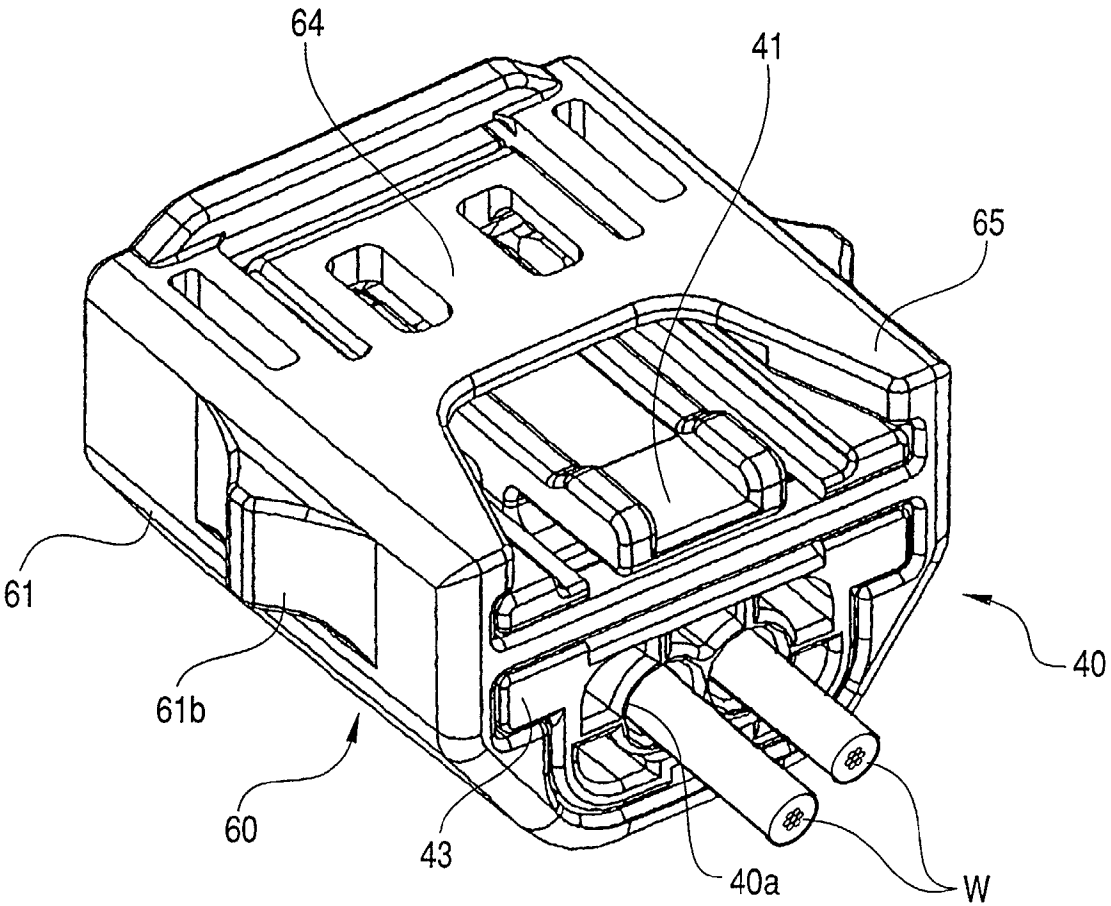
FIG. 3 is a perspective view illustrating a state in which the connection terminals have been inserted in FIG. 1.
Figure 4:
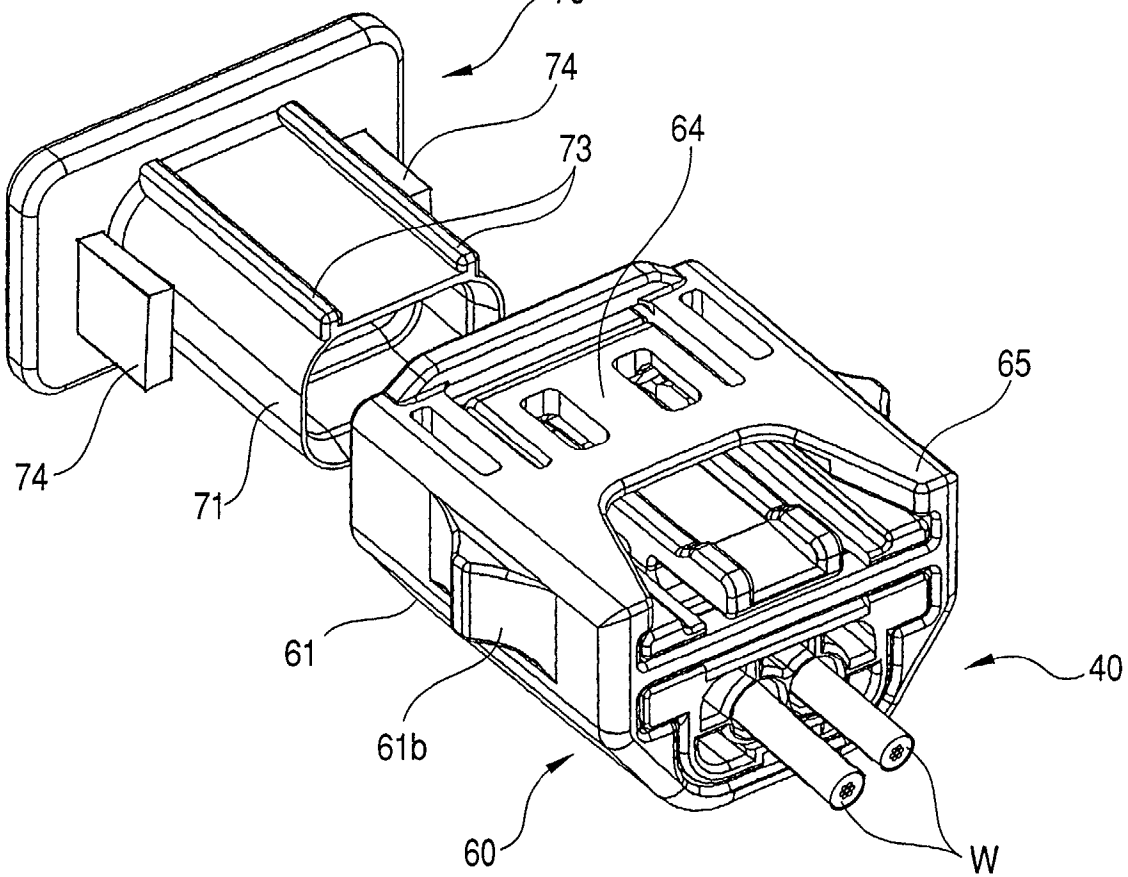
FIG. 4 is a perspective view illustrating a state before the fitting of a checker fixture from the state shown in FIG. 3.
Figure 5:
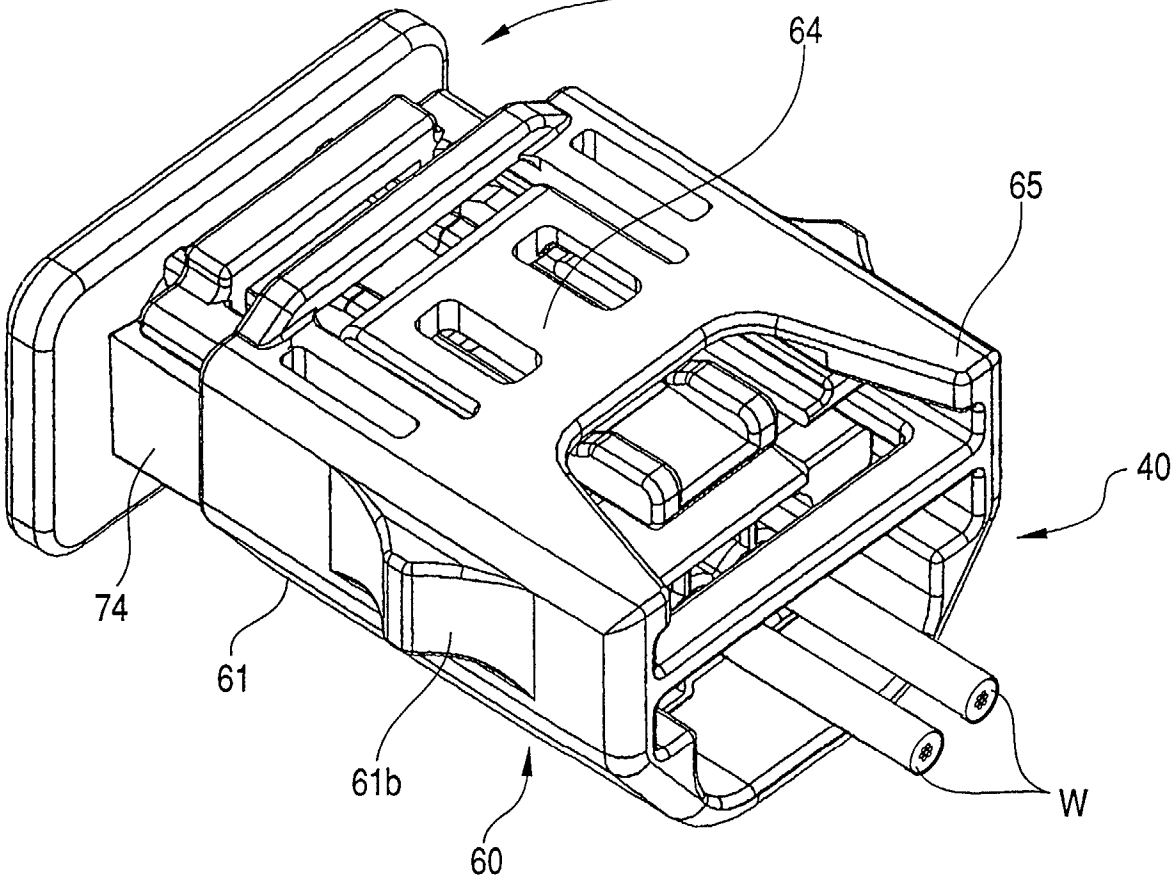
FIG. 5 is a perspective view illustrating a state after the fitting of the checker fixture from the state shown in FIG. 4.
Figure 6:
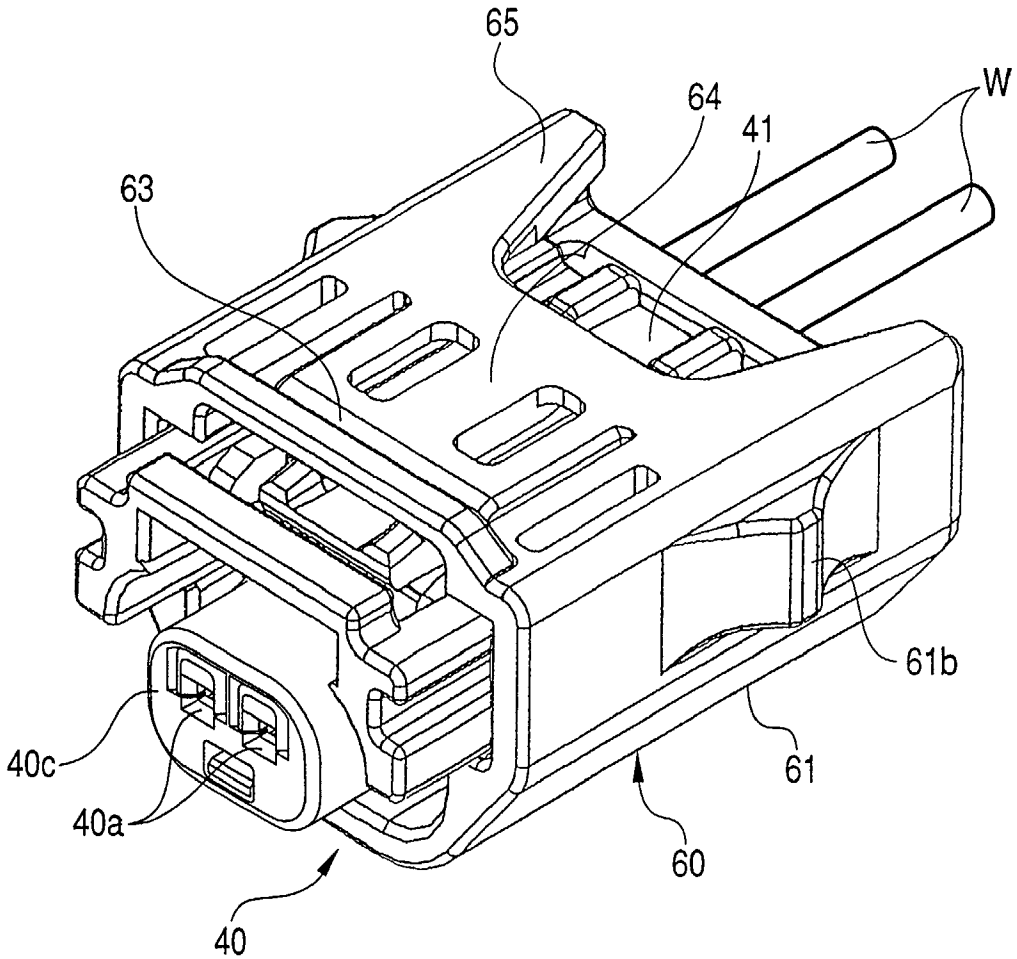
FIG. 6 is a perspective view illustrating a state before the fitting of the connectors from the state shown in FIG. 5.
Figure 7:
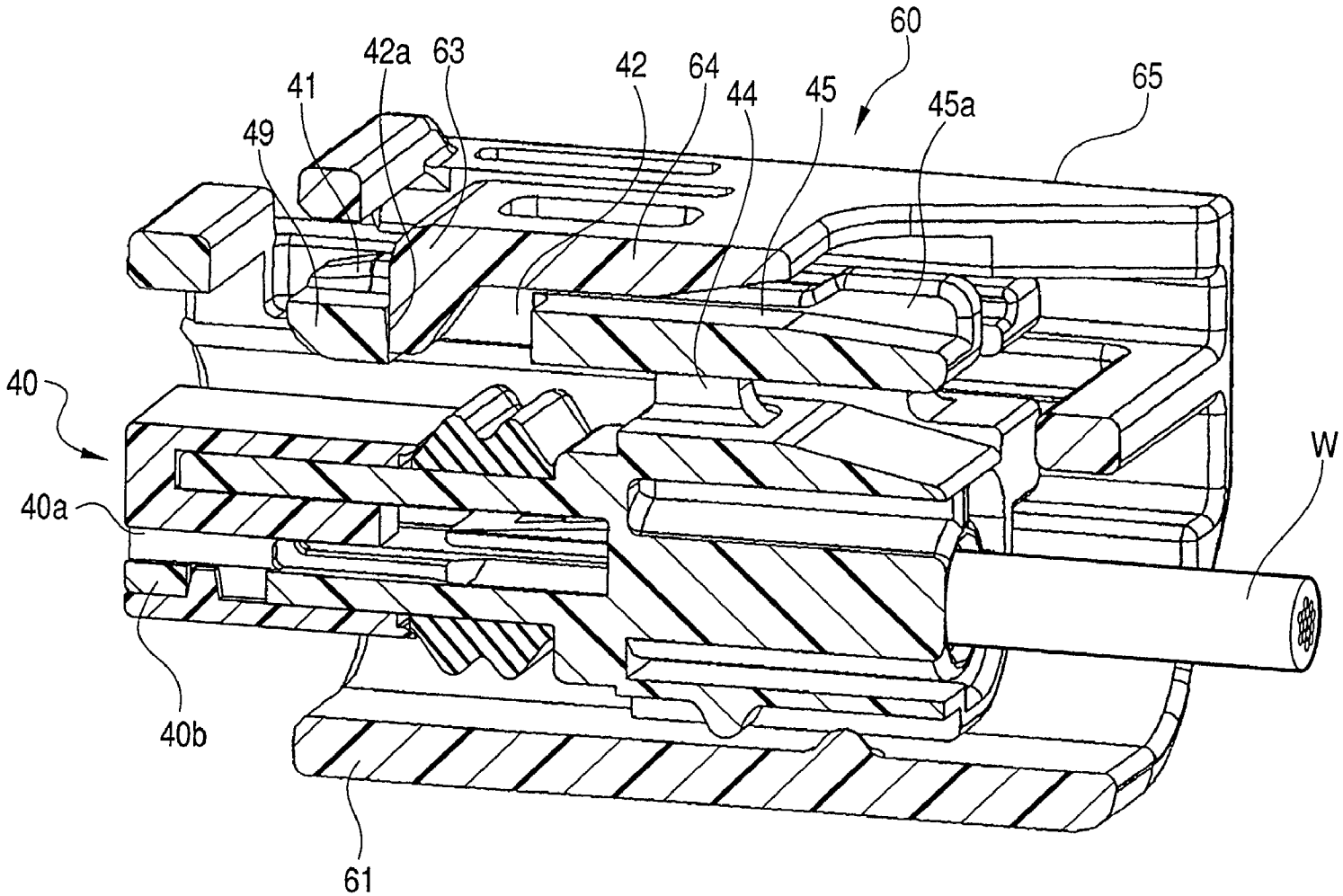
FIG. 7 is a vertical cross-sectional view in FIG. 6.
Figure 8:
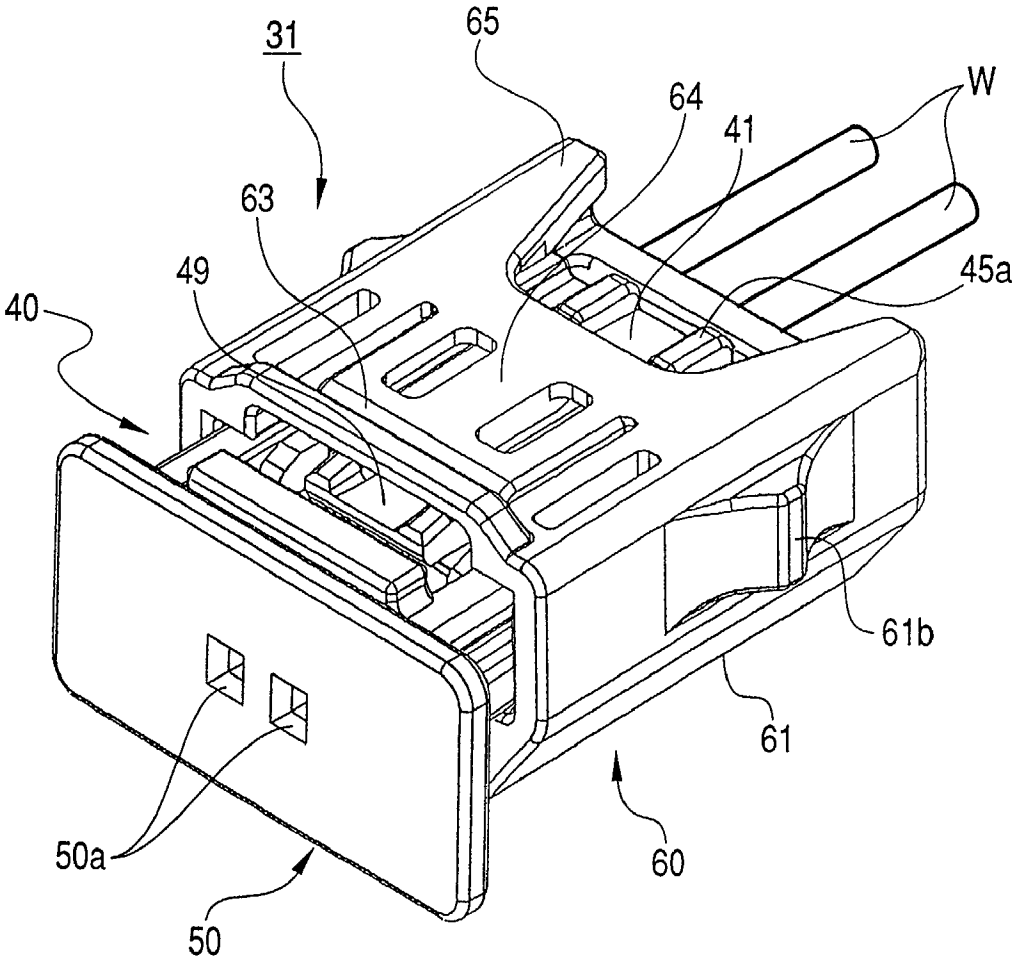
FIG. 8 is a perspective view illustrating a state in which the male and female connector housings are being fitted in accordance with the first embodiment.
Figure 9:
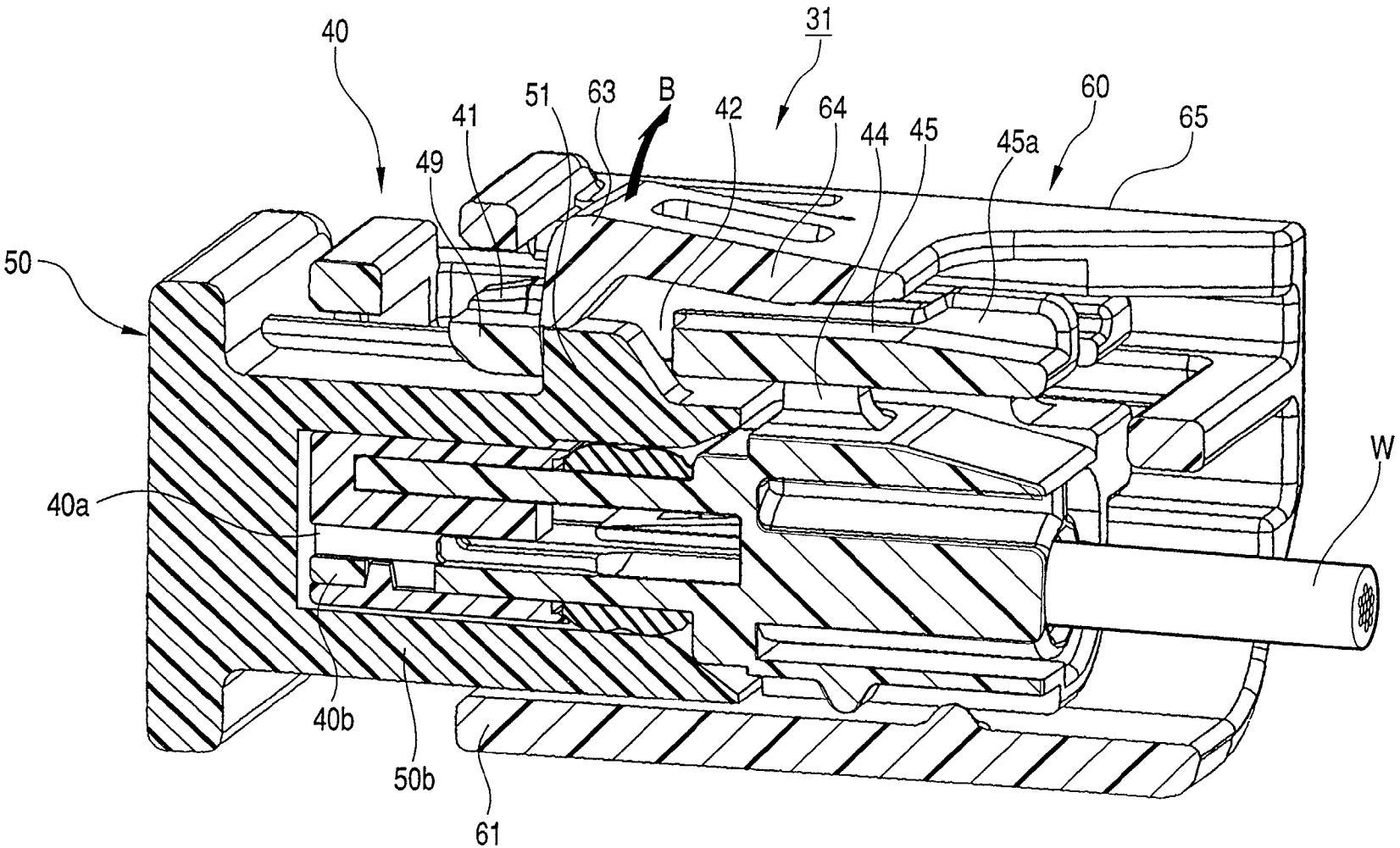
FIG. 9 is a vertical cross-sectional view in FIG. 8.
Figure 10:
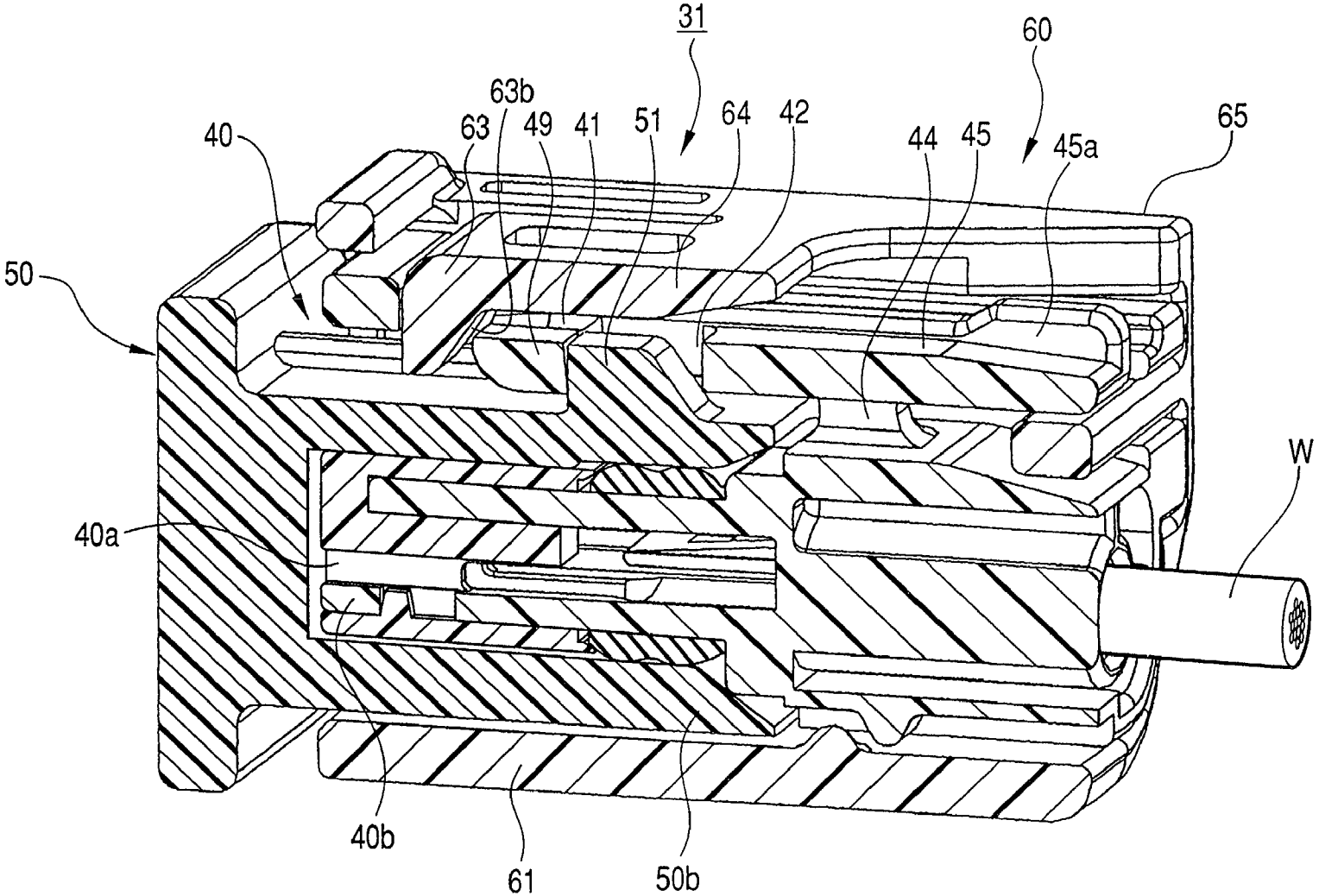
FIG. 10 is a vertical cross-sectional view illustrating a completely fitted state of the male and female connector housings in FIG. 9.

Referring now to FIGS. 1 to 10, a detailed description will be given of a preferred first embodiment of the method of automatically inserting connection terminals into a half-fitting prevention connector in accordance with the invention. FIG. 1 is an exploded perspective view illustrating the first embodiment of the method of automatically inserting connection terminals into a half-fitting prevention connector in accordance with the invention. FIG. 2 is a perspective view illustrating a state in which a fitting detection member is incorporated in a female connector housing in FIG. 1. FIG. 3 is a perspective view illustrating a state in which the connection terminals have been inserted in FIG. 1. FIG. 4 is a perspective view illustrating a state before the fitting of a checker fixture from the state shown in FIG. 3. FIG. 5 is a perspective view illustrating a state after the fitting of the checker fixture from the state shown in FIG. 4. FIG. 6 is a perspective view illustrating a state before the fitting of the connectors from the state shown in FIG. 5. FIG. 7 is a vertical cross-sectional view in FIG. 6. FIG. 8 is a perspective view illustrating a state in which the male and female connector housings are being fitted. FIG. 9 is a vertical cross-sectional view in FIG. 8. FIG. 10 is a vertical cross-sectional view illustrating a completely fitted state of the male and female connector housings in FIG. 9.

As shown in FIG. 1, a half-fitting prevention connector 31 of this embodiment is comprised of a female connector 40 which is a first connector housing having a flexible lock arm 41; a substantially tubular fitting detection member 60 which is attached over the female connector 40 slidably along the engaging direction; and an unillustrated male connector which is the second connector housing.

The female connector 40 of this embodiment has a structure in which a housing body 40*b* having terminal accommodating chambers 40*a* formed therein for accommodating and holding unillustrated female connection terminals, the flexible lock arm 41 formed on an upper surface of the housing body 40*b*, and a pair of guide portions 43 for slidably supporting the fitting detection member 60 are integrally molded. Further, a front holder 40*c* is fitted to a front end of the housing body 40*b*, and terminal accommodating chambers 40*a* continuing to the housing body 40*b* are formed therein.

The flexible lock arm 41 is formed such that an arm portion 45 extending along the back-and-forth direction of the housing body 40*b* is connected to an upper end of a column portion 44 provided uprightly substantially in the center of the upper surface of the housing body 40*b*. The arm portion 45 is flexibly displaceable vertically with the column portion 44 as a fulcrum.

In addition, the retaining hole 42 in the flexible lock arm 41 is provided at a position close to a front end of the arm portion 45. Further, a pair of cancellation operating portions 45*a* for upwardly displacing the front end of the arm portion 45 are provided on the upper surface of the arm portion 45 at a position close to a rear end thereof.

Accordingly, in the state in which the male and female connectors are fitted, if the cancellation operating portions 45*a* are pressed down to upwardly displace the front end of the arm portion 45, the state of engagement between the retaining hole 42 and the unillustrated male connector can be canceled.

In addition, the pair of guide portions 43 are respectively provided on both sides of the upper surface of the housing body 40*b*. Each of these guide portions 43 has in an outer surface portion a guide slot 43*a* extending along the back-and-forth direction of the housing body 40*b*.

In addition, the fitting detection member 60 of this embodiment has a substantially tubular detection member body 61 which is attached over outer peripheries of the female connector 40 slidably in an axial direction along the engaging direction of the female connector 40 so as to cover the outer surfaces of the housing body 40*b*, as well as the retaining projection 63 which is a positioning portion for restricting the detection member body 61 to its initial position (corresponding to first position) by its engagement with the retaining hole 42.

As for the detection member body 61, a pair of guide projections 61*a* which slidably fit in the guide slots 43*a* of the guide portions 43 are respectively formed on both inner side surfaces. As the guide slots 43*a* and the guide projections 61*a* are fitted, the detection member body 61 is attached over the female connector 40 slidably along the axial direction of the female connector 40.

In addition, a pair of nonslip portions 61*b* which are pinched by fingers when the detection member body 61 is slidingly moved are respectively provided on both outer side surfaces.

The retaining projection 63 is projectingly provided on a lower portion of a distal end of a retaining arm 64, which is a resilient piece forming a portion of the upper wall of the detection member body 61, and the retaining projection 63 is displaceable in conjunction with the upward resilient displacement of the retaining arm 64. This retaining projection 63 is fitted from above into the retaining hole 42 with its front end face abutting against a front end face 42*a* (see FIG. 7) of the retaining hole 42, so as to allow the fitting detection member 60 to be engaged in the initial position.

In this embodiment, a proper-fitting detecting position (corresponding to second position) to which the fitting detection member 60 is slidingly moved is set to a position closer to a front end of the female connector 40 than the initial position where the retaining projection 63 is retained in the retaining hole 42. For this reason, the female connector 40 is provided with a detection member retaining portion 49 for restricting the sliding movement of the fitting detection member 60 when the fitting detection member 60 has slidingly moved from the initial position to the proper-fitting detecting position on the front side.

When the fitting detection member 60 has slidingly moved to the proper-fitting detecting position, the detection member retaining portion 49 retains a rear end face 63*b* (see FIG. 10) of the retaining projection 63 by a front edge of the arm portion 45 of the flexible lock arm 41, thereby positioning and fixing the fitting detection member 60 in the proper-fitting detecting position. At this time, as a clicking feeling is produced when the retaining projection 63 is retained by the detection member retaining portion 49, it is possible to detect the completely fitted state of the male and female connectors.

As shown in FIGS. 2 and 3, the fitting detection member 60 is provided with a pair of extended portions 65 so as to allow the fitting detection member 60, when located in the initial position, to clearly project from the rear end of the housing of the female connector 40. Rear ends of these extended portions 65 are set so as to substantially coincide with the rear end surface of the female connector 40 when the fitting detection member 60 is located in the proper-fitting detecting position.

Before the connection terminals are automatically inserted by an unillustrated automatic terminal inserting machine, the fitting detection member 60 is moved to the proper-fitting detecting position.

Next, unillustrated connection terminals connected to end portions of wires W, after being supplied to the automatic terminal inserting machine with the rear end surface of the female connector 40 and the rear end of the fitting detection member 60 substantially coinciding with each other, are automatically inserted into the terminal accommodating chambers 40*a*, as shown in FIG. 3.

Next, as shown in FIG. 4, a checker fixture 70 for electrically detecting the state of insertion of the connection terminals in the aforementioned terminal accommodating chambers 40*a* (see FIG. 3) is fitted to the female connector 40 from the front side thereof.

As for the checker fixture 70, a pair of protruding portions 73 for guiding are formed on top of a substantially tubular housing body 71, and a pair of pressing pieces 74 are projectingly provided on both side portions of the housing body 71. These pressing pieces 74 are members for pushing back the fitting detection member 60 from the proper-fitting detecting position to the initial position by coming into contact with the front end of the fitting detection member 60.

Then, when the checker fixture 70 is fitted as shown in FIG. 5, the state of insertion of the connection terminals in the terminal accommodating chambers 40*a* is electrically inspected. At the same time, the pressing pieces 74 abut against the front end of the fitting detection member 60 to move the fitting detection member 60 from the proper-fitting detecting position to the initial position.

Next, as shown in FIGS. 6 and 7, before the fitting of the male and female connectors, the fitting detection member 60 attached over the female connector 40 is restricted to the initial position by being retained by the retaining hole 42 in the female connector 40 in such a manner as to cover the female connector 40.

Next, as shown in FIGS. 8 and 9, at the time of the operation of engaging a male connector 50 and the female connectors 40, the length of fitting of the housings reaches a predetermined value, and an engaging projection 51 is fitted in the retaining hole 42 from below the arm portion 45. The fitted state of the male and female connectors 50 and 40 is locked by the engagement between this engaging projection 51 and the retaining hole 42.

At this time, as indicated by arrow B in FIG. 9, the retaining projection 63 of the fitting detection member 60 which was engaged in the retaining hole 42 is pushed upward by the engaging projection 51, so that the positional restriction of the fitting detection member 60 to the initial position is canceled. Accordingly, the fitting detection member 60 becomes movable toward the front side of the housing of the female connector 40.

Then, upon completion of the housings-engaging operation, the detection member moving operation is effected to move the fitting detection member 60 from the initial position to the proper-fitting detecting position so as to detect the fitted state of the male and female connectors 50 and 40. Namely, since the fitting detection member 60 was being pinched by the operator's fingers at the time of the housings-engaging operation, at the time of the detection member moving operation the operator pushes the fitting detection member 60 toward the front side of the housing in this state without changing the fingers which were pinching the fitting detection member 60. Consequently, it is possible to efficiently perform the detection member moving operation for detecting the completely fitted state of the male and female connectors 50 and 40.

In addition, since the urging direction in the detection member moving operation is the same as that in the housings-engaging operation, in the pressing operation for effecting the housings-engaging operation, the operation can be completed at a stroke including the detection member moving operation, thereby making it possible to reduce the number of operations when the male and female connectors are connected.

Then, as shown in FIG. 10, when the fitting detection member 60 reaches the proper-fitting detecting position, the retaining projection 63 of the fitting detection member 60 is retained by the detection member retaining portion 49 which is the front edge of the arm portion 45, thereby restricting the sliding movement of the fitting detection member 60. Accordingly, as a clicking feeling is produced when the fitting detection member 60 is retained by the detection member retaining portion 49, it is possible to detect the completely fitted state of the male and female connectors 50 and 40.

In the above-described first embodiment, the case has been shown in which the rear end of the fitting detection member is made to substantially coincide with the rear end surface of the connector when the connection terminals are automatically inserted.

Figure 11:
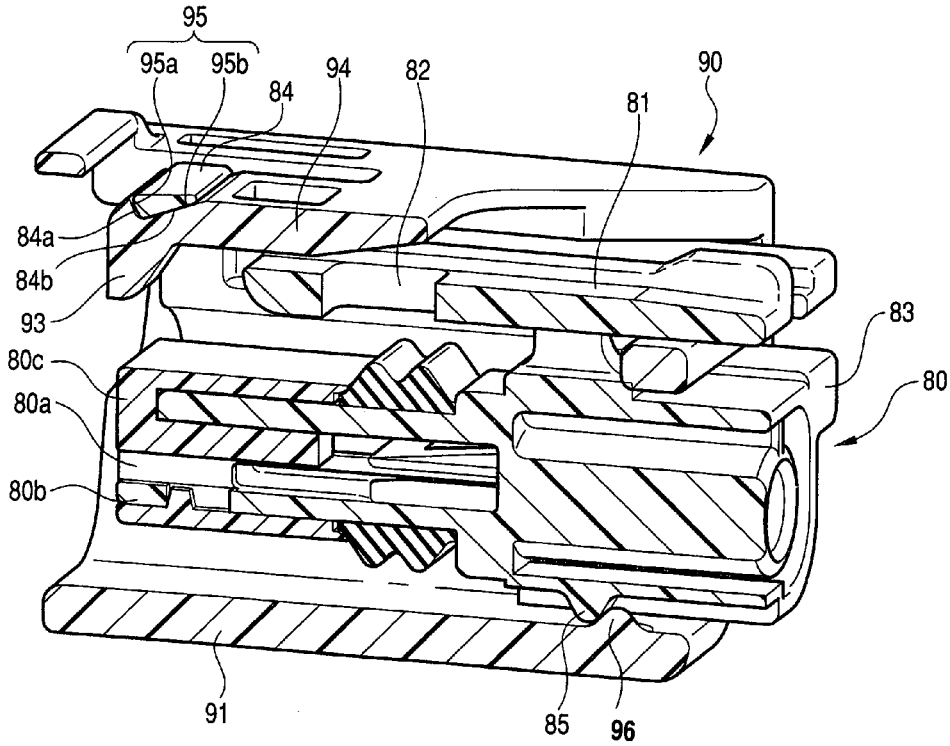
FIG. 11 is a vertical cross-sectional view illustrating a state in which the fitting detection member is incorporated in the female connector so as to permit the automatic insertion of terminals in accordance with a second embodiment of a method of automatically inserting connection terminals into a half-fitting prevention connector in the invention.
Figure 12:
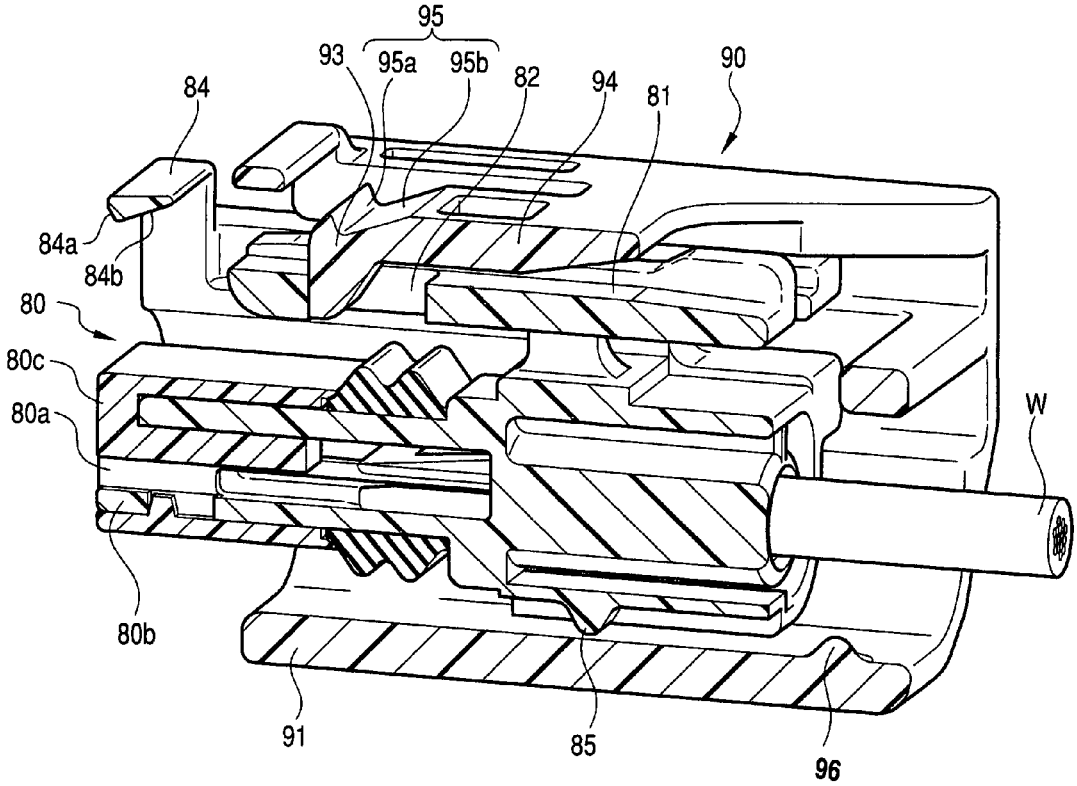
FIG. 12 is a vertical cross-sectional view illustrating a state before the fitting of the connectors in accordance with a second embodiment.
Figure 13:
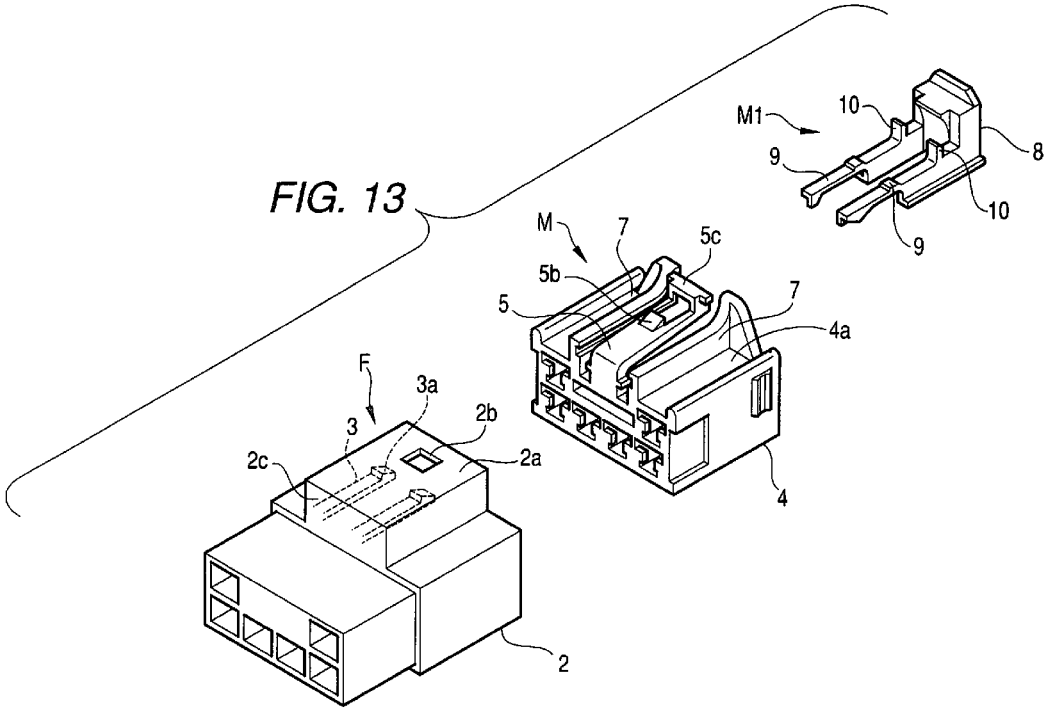
FIG. 13 is a vertical cross-sectional view illustrating a state before the fitting in a conventional half-fitting prevention connector.
Figure 14:
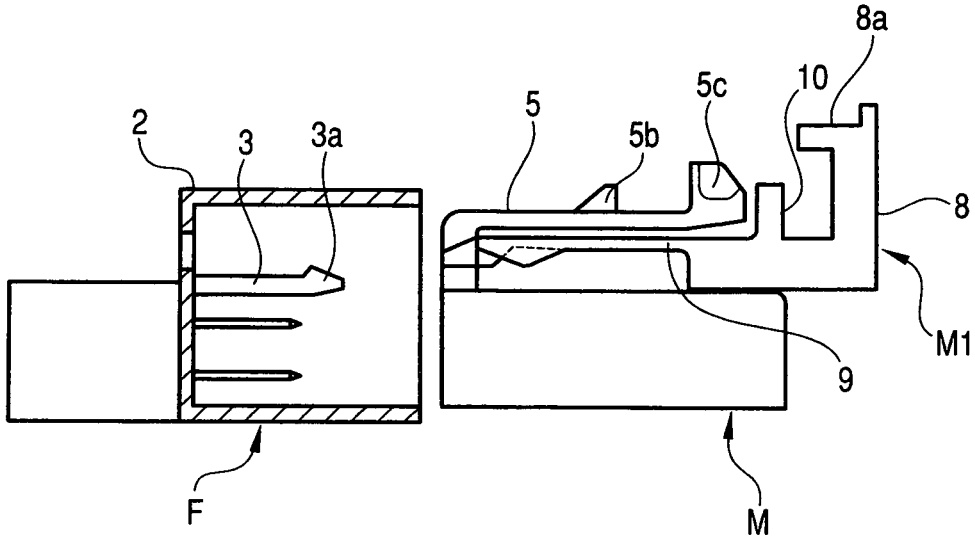
FIG. 14 is an explanatory diagram of the operation illustrating a state before the fitting of the male and female connector housings in FIG. 13.
Figure 15:
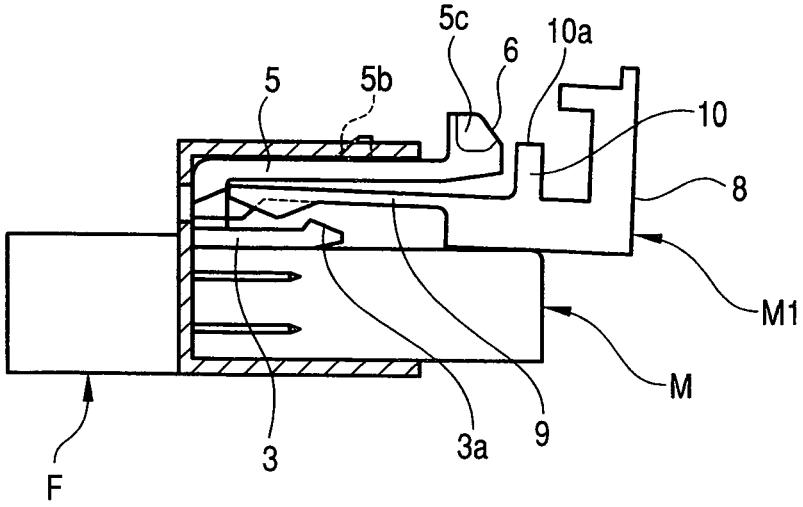
FIG. 15 is an explanatory diagram of the operation illustrating a state in the course of fitting in FIG. 14.
Figure 16:
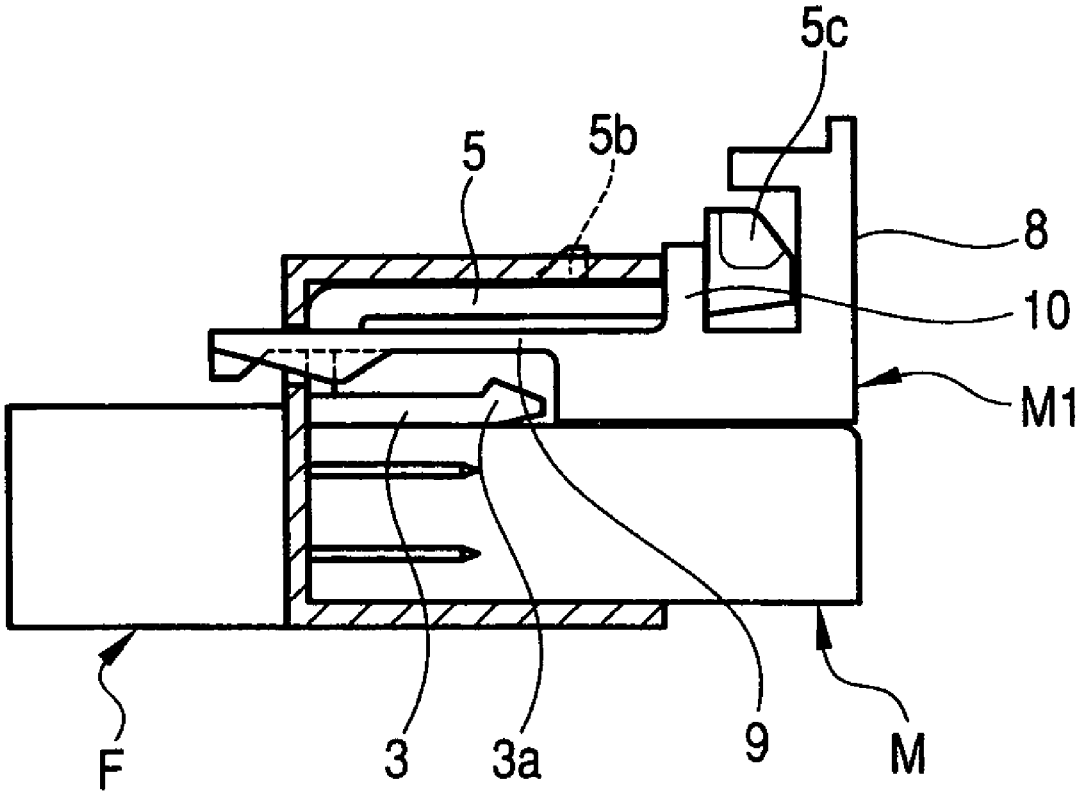
FIG. 16 is an explanatory diagram of the operation illustrating a state in which the fitting of the connector housings in FIG. 15 has been completed, and the sliding movement of the fitting detection member to a proper-fitting detecting position has been completed.

Next, referring to FIGS. 11 and 12, a description will be given of a second embodiment in which the rear end of the fitting detection member is located forwardly of the rear end of the female connector when the connection terminals are automatically inserted. FIG. 11 is a vertical cross-sectional view in which the fitting detection member is incorporated in the female connector so as to permit the automatic insertion of the terminals. FIG. 12 is a vertical cross-sectional view illustrating a state after the insertion of the connection terminals and before the fitting of the connectors.

As shown in FIG. 11, a fitting detection member 90, after being incorporated in a female connector 80, is moved such that the rear end of the detection member 90 is located forwardly of the rear end surface of the female connector 80 so as to effect the terminal insertion using the automatic terminal inserting machine.

The female connector 80 has a structure in which a housing body 80*b* having terminal accommodating chambers 80*a* formed therein for accommodating and holding unillustrated female connection terminals, the flexible lock arm 81 formed on an upper surface of the housing body 80*b* and having a retaining hole 82, and a pair of guide portions 83 for slidably supporting the fitting detection member 90 are integrally molded. Further, a front holder 80*c* is fitted to a front end of the housing body 80*b*, and terminal accommodating chambers 80*a* continuing to the housing body 80*b* are formed therein.

The flexible lock arm 81 and the guide portion 83 are constructed in the same way as the flexible lock arm 41 and the guide portion 43 in the above-described first embodiment, so that a detailed description thereof will be omitted.

In addition, a retaining rib 84 is formed on top of the front end of the female connector 80. Tapered surfaces 84*a* and 84*b* are formed on the retaining rib 84 so as to be capable of being retained in a retaining groove of a retaining arm 94 which will be described later.

The tapered surface 84*a* abuts against a front surface 95*a* of the retaining groove 95 to restrict the movement of a fitting detection member body 91 in the rearward direction. However, the tapered surface 84*a* has an angle of inclination of such a degree that when the fitting detection member 90 is pressed in the rearward direction by the checker fixture, the retaining arm 94 is resiliently displaced downward to cancel the retention between the retaining rib 84 and the retaining groove 95.

In addition, the tapered surface 84*b* is formed as an inclined surface which is gentler than the tapered surface 84*a* such that at the time of engaging the retaining rib 84 and the retaining groove 95, the tapered surface 84*b* comes into sliding contact with an upper portion of the front end of the retaining arm 94 so as to resiliently displace the retaining arm 94 downward.

Further, the female connector 80 in accordance with this embodiment has a rib-like first projection 85 provided on its outer periphery on the side away from the flexible lock arm 81 in such a manner as to extend in a transverse direction perpendicular to the engaging direction. In addition, as the shape of the first projection 85, a triangular cross-sectional shape or a semicircular shape having a gentle inclined surface is preferable. The first projection 85 engages a second projection 96, which will be described later, so as to restrict the movement of the fitting detection member body 91 forwardly of the set position at the time of insertion of terminals.

The fitting detection member 90 has the substantially tubular detection member body 91 which is attached over outer peripheries of the female connector 80 slidably in the axial direction along the engaging direction of the female connector 80 so as to cover the outer surfaces of the housing body 80*b*, as well as the retaining arm 94 for restricting the detection member body 91.

The retaining arm 94 is a resilient piece which forms a portion of the upper wall of the detection member body 91 and is resiliently displaceable vertically. The retaining arm 94 has a retaining projection 93 which is a positioning portion for engaging the retaining hole 82 to restrict the detection member body 91 to the initial position. The retaining projection 93 is projectingly provided on a lower portion of a distal end of the retaining arm 94, and is displaced vertically in conjunction with the resilient displacement of the retaining arm 94. In addition, the retaining groove 95 for engaging the aforementioned retaining rib 84 is formed in an upper surface of the retaining arm 94 so as to restrict the detection member body 91 to the position persisting at the time of terminal insertion. Formed on the retaining groove 95 are a front surface 95*a* and a rear surface 95*b* respectively having inclinations substantially coinciding with those of the tapered surface 84*a* and the tapered surface 84*b* so as to be capable of retaining the retaining rib 84.

In addition, in addition to the arrangement similar to the detection member body 61 in the above-described first embodiment, the detection member body 91 has on its periphery the boss-like second projection 96 for engaging the first projection 85 at the time of insertion of the connection terminals.

By virtue of the above-described construction, at the time of terminal insertion by the automatic terminal inserting machine, the rear end of the fitting detection member 90 is moved so as to be located forwardly of the rear end surface of the female connector 80, and the position of the fitting detection member 90 is restricted. More specifically, by the engagement between the first projection 85 and the second projection 96 and the engagement between the retaining rib 84 and the retaining groove 95 of the retaining arm 94, the fitting detection member 90 is restricted to such an extent that it does not easily move forward or rearward.

Next, the connection terminals connected to end portions of wires, after being supplied to the automatic terminal inserting machine with the rear end of the fitting detection member 90 restricted to the position located forwardly of the rear end surface of the female connector 80, are automatically inserted into the terminal accommodating chambers 80*a*.

Next, as the checker fixture (see FIG. 4) having the pressing pieces is fitted in the female connector 80 by an operation similar to that of the above-described first embodiment, the fitting detection member 90 is moved from the position at the time of terminal insertion to the initial position where the fitting detection member 90 projects rearwardly of the rear end surface of the female connector 80.

Namely, as shown in FIG. 12, the fitting detection member 90 attached over the female connector 80 is restricted to the initial position by the engagement between the retaining projection 93 and the retaining hole 82 of the female connector 80 in such a manner as to cover the female connector 80.

Since the operation of engaging the male and female connectors is similar to that of the above-described first embodiment, a description thereof will be omitted.

As described above, in accordance with the half-fitting prevention connector of the invention, the connection terminals are automatically inserted after the fitting detection member is moved to the position where the rear end of the detection member substantially coincides with the rear end surface of the first connector housing, or the position where the rear end of the detection member is located forwardly of the rear end surface of the first connector housing. Further, the operation of engaging the connector housings is effected after the fitting detection member is moved to an initial position where the fitting detection member projects rearwardly of the rear end surface of the first connector housing.

Accordingly, since the rear end of the fitting detection member attached over the first connector housing does not project from that connector housing, the connection terminals can be automatically inserted by the automatic terminal inserting machine. Accordingly, it is possible to improve the efficiency in the operation of inserting the connection terminals into the connector housing and in the operation of engaging the connector housings.

What is claimed is:

1. An inserting method of inserting connection terminals into a half-fitting prevention connector including a first connector housing having a flexible lock arm, a second connector housing having an engaging portion for engaging a lock portion of the lock arm and adapted to be connected to the first connector housing by engagement between the lock portion and the engaging portion at the time of fitting with the first connector housing, and a fitting detection member attached over the first connector housing slidably along fitting direction of the connector housings so as to detect a half-fitted state of the connector housings according to whether or not the fitting detection member is able to slidingly move from a first position before fitting of the first and second connector housings to a second position after the fitting of the first and second connector housings, the inserting method comprising the steps of:

moving the fitting detection member by sliding the fitting detection member over the first connector housing to a position where a rear end of the fitting detection member substantially coincides with a rear end surface of the first connector housing or a position where the rear end of the fitting detection member is located forwardly of the rear end surface of the first connector housing;

inserting the connection terminals into the first connector housing;

moving the fitting detection member by sliding the fitting detection member over the first connector housing to the first position where the rear end of the fitting detection member projects rearwardly of the rear end surface of the first connector housing;

effecting an operation of engaging the first connector housing with the second connector housing; and indicating a half-fitted connection state of the first connector housing and the second connector housing, wherein the fitting detection member is retained in the first position and prevented from slidingly moving to the second position if the first connector housing and the second connector housing are in the half-fitted connection state and the fitting detection member is slidingly movable from the first position to the second position if the first connector housing and the second connector housing are not in the half-fitted connection state.

2. The inserting method of the connection tenninals into the half-fitting prevention connector according to claim 1, wherein the connection terminals are automatically inserted into the first connector housing by an automatic terminal inserting machine.

3. The inserting method of the connection terminals into the half-fitting prevention connector according to claim 1, wherein the fitting detection member is located at the second position when the connection terminals are inserted into the first connector housing.

4. The inserting method of the connection terminals into the half-fitting prevention connector according to claim 3, wherein the rear end of the fitting detection member is flush with the rear end surface of the first connector housing when the fitting detection member is located at the second position.

5. The inserting method of the connection terminals into the half-fitting prevention connector according to claim 4, further comprising the steps of moving the fitting detection member to the second position and detecting a complete fitting of the first and second connector housing.

6. The inserting method of the connection terminals into the half-fitting prevention connector according to claim 1, wherein a direction of the slidable movement of the fitting detection member from the first position to the second position is in an axial direction along the engaging direction of the first connector housing and the second connector housing.

7. The inserting method of the connection terminals into the half-fitting prevention connector according to claim 1, wherein the fitting detection member is attached over outer peripheries of the first connector housing slidably in an axial direction along an engaging direction of the first connector housing and the second connector housing.

* * * * *